US010194721B2

(12) United States Patent
Cavasino

(10) Patent No.: US 10,194,721 B2
(45) Date of Patent: Feb. 5, 2019

(54) SERRATED BEACH POLE WITH FINS, SLEEVE AND ROTATION AND FIXATION LEVER

(71) Applicant: Luciano Alberto Cavasino, Cagliari (IT)

(72) Inventor: Luciano Alberto Cavasino, Cagliari (IT)

( * ) Notice: Subject to any disclaimer, the term of this patent is extended or adjusted under 35 U.S.C. 154(b) by 134 days.

(21) Appl. No.: 15/036,013

(22) PCT Filed: Oct. 8, 2014

(86) PCT No.: PCT/IT2014/000265
§ 371 (c)(1),
(2) Date: May 11, 2016

(87) PCT Pub. No.: WO2015/063803
PCT Pub. Date: May 7, 2015

(65) Prior Publication Data

US 2018/0030753 A1 Feb. 1, 2018

(30) Foreign Application Priority Data

Nov. 4, 2013 (IT) ..... CA20130013 U

(51) Int. Cl.
*A45B 23/00* (2006.01)
*E04H 15/28* (2006.01)
(Continued)

(52) U.S. Cl.
CPC ..... *A45B 23/00* (2013.01); *A45B 3/00* (2013.01); *E04H 12/2223* (2013.01);
(Continued)

(58) Field of Classification Search
CPC ... A45B 25/22; A45B 2023/0012; A45B 3/00; A45B 2023/0006; A45B 23/00;
(Continued)

(56) References Cited

U.S. PATENT DOCUMENTS 1,218,357 A * 3/1917 Bauer ..... A47B 3/12 108/158
1,791,368 A 2/1931 Mullet
(Continued)

OTHER PUBLICATIONS

International Search Report and Written Opinion dated Apr. 28, 2015 (PCT/IT2014/000265); ISA/EP.

*Primary Examiner* — Winnie Yip
(74) *Attorney, Agent, or Firm* — Banner & Witcoff, Ltd.

(57) ABSTRACT

A beach umbrella comprises a lower pole section and separate upper pole section with a canopy. The pole sections may be connected by inserting the lower end of the upper section into a sleeve on the upper end of the lower section. The sleeve includes a hinged lever arm that may be positioned to permit manual rotation of the lower section to bore the lower pole securely into the soil and thereby permit coupling of the upper section to the lower section positioned in the ground. The lower end of the lower section includes a hollow tubular sleeve with outwardly projecting fins or blades to bore into the soil when the lower pole section is rotated and axially projecting teeth to pierce the sand.

8 Claims, 6 Drawing Sheets

(51) Int. Cl.
*E04H 12/22* (2006.01)
*A45B 3/00* (2006.01)

(52) U.S. Cl.
CPC ..... *E04H 15/28* (2013.01); *A45B 2023/0006* (2013.01); *A45B 2023/0012* (2013.01)

(58) Field of Classification Search
CPC ..... F16M 13/00; E04H 12/34; E04H 12/347; E04H 12/22; E04H 12/2223; E04H 12/2215
USPC ..... 135/15.1, 16, 77–81, 118, 902; 52/166, 52/156–157, 163, 167; 248/156, 545, 248/530, 508
See application file for complete search history.

(56) References Cited

U.S. PATENT DOCUMENTS 2,643,843 A * 6/1953 Brown ..... E04H 12/2223 248/156
4,290,245 A * 9/1981 Pardue, Jr. ..... E02D 5/801 52/157
5,046,699 A * 9/1991 Perreault ..... E04H 12/2223 135/16
5,122,014 A * 6/1992 Genfan ..... E02D 5/801 248/156
5,293,889 A * 3/1994 Hall ..... A45B 3/00 135/16
5,358,209 A * 10/1994 Ward ..... E04H 12/2223 248/530
5,396,916 A * 3/1995 Boissonnault ..... A45B 7/005 135/16
5,482,246 A * 1/1996 Derkoski ..... E02D 5/801 248/156
5,535,978 A * 7/1996 Rodriguez ..... E04H 12/2269 135/118
5,906,077 A * 5/1999 Andiarena ..... E04H 12/2223 135/118
2001/0017150 A1* 8/2001 Doreste ..... A45B 17/00 135/15.1
2006/0060749 A1* 3/2006 Dahlstrom ..... A45F 3/44 248/545
2007/0137681 A1* 6/2007 Tatz ..... A45B 3/06 135/16

* cited by examiner

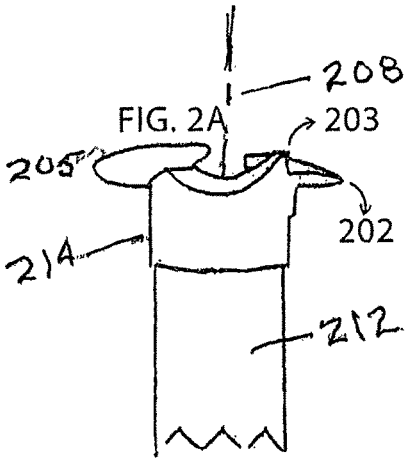
FIG. 2A
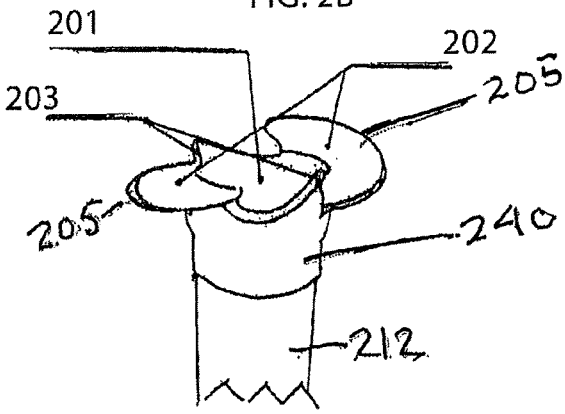
FIG. 2B
FIG. 2C
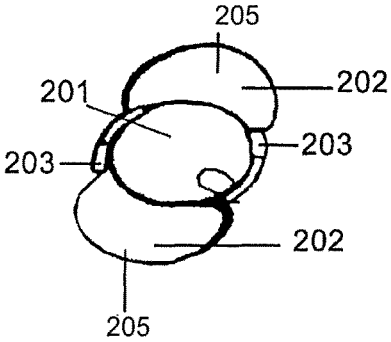
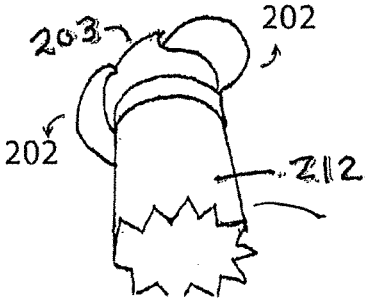
FIG. 2D

SERRATED BEACH POLE WITH FINS, SLEEVE AND ROTATION AND FIXATION LEVER

CROSS-REFERENCE TO RELATED APPLICATIONS

The present application is a U.S. National Phase of International Application No. PCT/IT2014/000265, filed Oct. 8, 2014, designating the United States of America, and claims priority to Italian Patent Application No. CA2013U000013 filed Nov. 4, 2013. This application claims the benefit of the above-identified application which is incorporated by reference herein in its entirety.

BACKGROUND OF THE INVENTION

This invention applies mainly to a means to ensure stable placement of a beach umbrella at the beach, and the placement of a pole of the umbrella into the sand at the beach.

This operation to place a beach umbrella, though trivial, may be difficult, as with traditional umbrella poles a person will either need great energy to push the pole down into the sand or to make a hole first in the sand.

Another small problem which may often occur with a beach umbrella, when going to the beach, is that the action of the wind may easily pull the umbrella out of the sand. One may often have seen beach umbrellas flying in the wind chased by their owners.

BRIEF SUMMARY OF THE INVENTION

This invention solves these problems.

Bearing in mind that a beach umbrella is made up of two separate parts, one is fixed to the ground, "the pole", and the other, the upper part including "the canopy" is fitted on the lower element pole and clamps firmly on the pole as depicted in FIG. 1.

By modifying a part of the pole fixed to the ground and providing that part with new elements which are described and claimed herein enable leaving the upper part the pole and (the canopy) unchanged. The whole design is the result of an accurate study, each part has been optimized in order to require the minimum effort and the minimal waste of time together with the maximum result, thus obtaining a very competitive product in terms of usefulness and cost.

BRIEF DESCRIPTION OF DRAWINGS

In the description which follows, reference will be made to the drawing comprised of the following figures:

FIG. 2A is a vertical side view of a lower end 212 of the lower part 200 of the center pole 302 depicting a hollow sleeve 240 with a bottom opening 201 with propeller shaped blades 202 and teeth 203;

FIG. 2B is a perspective view of the lower end 212 with blades 202 and teeth 203 projecting from the lower wall opening of the hollow sleeve 240 depicted in FIG. 2A;

FIG. 2C is a further perspective view of the hollow sleeve 240 of FIG. 2A a bottom opening 201 and outer wall with blades 202 and teeth 203;

FIG. 2D is a perspective view of FIG. 2A viewed toward the hollow sleeve opening 201 at the lower end 212 of the lower pole part 200 with blades or fins 202 and teeth 203;

DETAILED DESCRIPTION OF AN EMBODIMENT OF THE INVENTION

Figure 1:
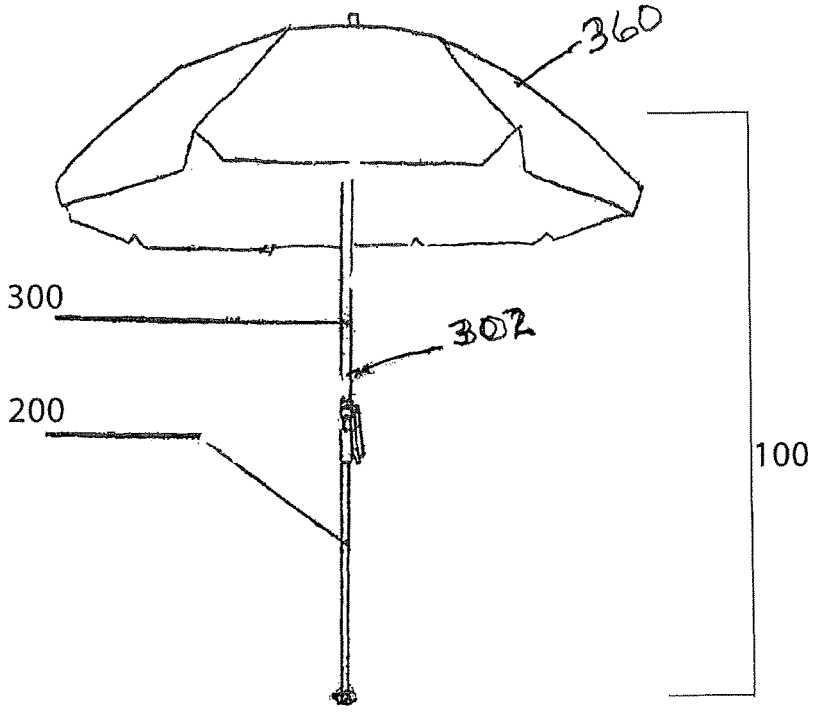
FIG. 1 is a perspective view of an embodiment of the beach umbrella 100 of the invention with a vertical center support pole 302 comprised of a lower pole section or part 200, for placement in sand, and an upper pole section or part 300 connectable to the lower part 200 and supporting an umbrella canopy 360.

An embodiment of the invention comprises serrated teeth 203 and finned propeller shaped blades 202 as elements fixed to lower part 200 hollow sleeve 240 of each umbrella center pole 302. The internal part of the sleeve 240 which is hollow so that the sand can flow in sleeve 240. A central hole or opening 301 in the lower part sleeve 240 of the pole lower part 200 will have a diameter of about 20 mm and wall diameter about 1 mm narrower, so that the sand can flow without any friction, and thus will allow the sand to be penetrated with reduced friction.

The sleeve 240 will be equipped with two side fins 202, in the shape of two small propellers 202, tilted about 20° with respect to the vertical axis 208, placed on the external part of sleeve 240 immediately above the serrated teeth element 203. The fins 202 will have a thinner front part 205 in the shape of a propeller. This device requires minimum penetration effort with maximum results. Finally, two small axial "teeth" 203 will help sand perforation. (FIGS. 2A, 2B, 2C and 2D).

The function via a lever arm 220 positioned on a fixed hollow sleeve 214 on the upper end part 210 of the lower part 200 of the pole 302 and equipped with a rotary knob 30. The lever arm 220 has the double purpose of enabling the rotation of the lower pole part 200 by its screwing and subsequently the locking of the upper part 300 of the umbrella canopy 360. The system enables the operation of this element, since in order to perform a rotary effort, without creating either breaking or bending. The lever arm 320 is supported by the slots of the hollow sleeve 214 opposite the hinge and to which the lever arm 220 is fixed.

Figure 3:
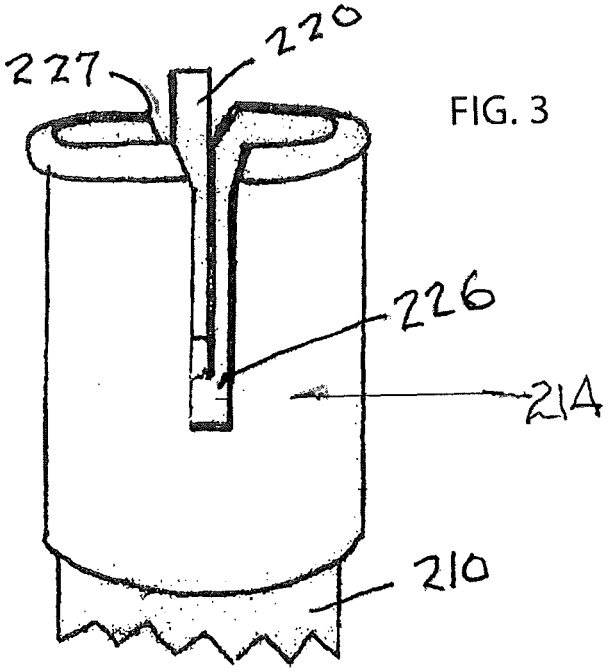
FIG. 3 is a perspective view of the upper end 210 of the lower pole part 200 of the center pole 302 depicting a lever arm 220 attached by a hinge 228 to a hollow sleeve 214 with slits 226, 227 affixed at the upper end 210 of the lower pole part 200 of the center pole 302.

As a matter of fact, the longitudinal slits 226, 227 in the pole sleeve 214 (FIG. 3), enable the rotation of lever arm

Figure 4A:
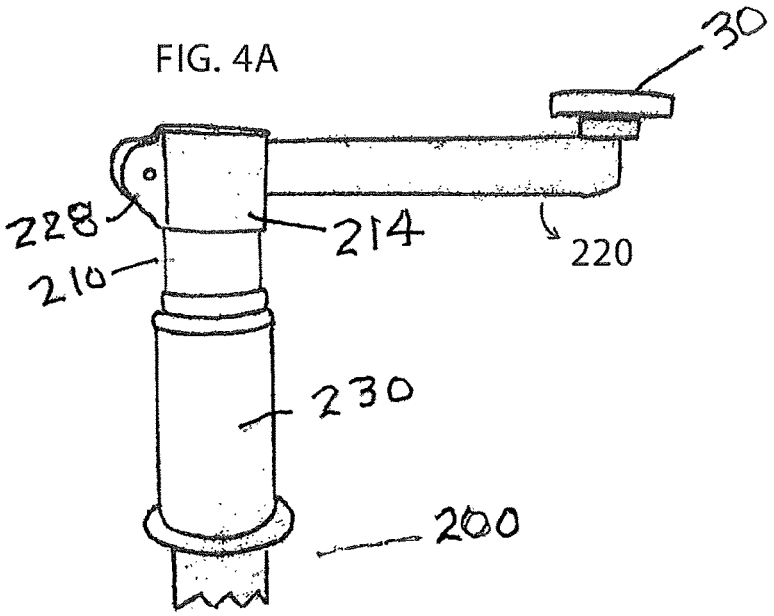
FIG. 4A is a side elevation of the upper end 210 of the lower part 200 of the center pole 302 with a lever arm 220 pivotally hinged by a hinge 228 to engage slits 226, 227 in the hollow sleeve 214.
Figure 4B:
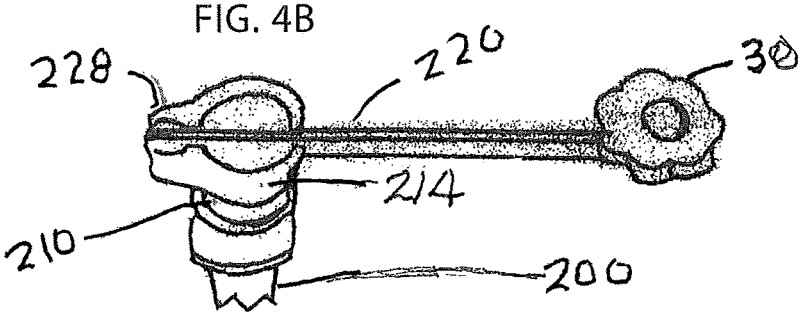
FIG. 4B is a top perspective view of FIG. 4A depicting the lever arm 220 in the slits 226, 227 of the sleeve 214 attached at the upper end 210 of the lower part 200 of the center pole 302.

220, in the working position for penetration to be achieved excellently when working against resistance to rotation of pole part 200 (FIG. 4A, FIG. 4B).

Equipping the top upper part 210 of the lower pole part 200 of the pole 302, a part immediately below the lever arm sleeve, with a sleeve 230 free to rotate around the pole lower part 200, permits a gripping function at the time of rotation, during the penetration of the pole lower part 200 itself. This will allow a free rotation of the sleeve 230 and will also facilitate its holding during the free rotation when placing the lower pole 200. (FIG. 5)

Figure 5:
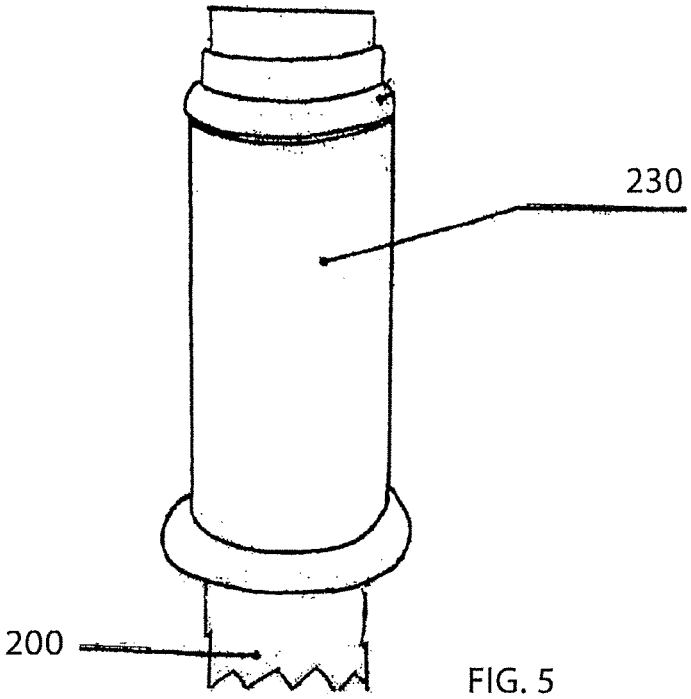
FIG. 5 is a side elevation view of the upper end 210 of the lower part 200 of the center pole 302 depicting a rotatable sleeve 230 located on the upper end 210 of the lower part 200 of the pole 302 below the attached sleeve 214 with the slits 226, 227 depicted in FIGS. 4A and 4B.

Method of Use:

Prepare the lower part sleeve 240 of the lower pole part 200 for rotation by placing lever arm 220 in the working position (FIG. 4A, FIG. 4B) and hold the sleeve 230 with the other hand (FIG. 5). Perform a rotation enabling the penetration of the pole part 200 into the sand.

Placement will be very fast.

Figure 6A:
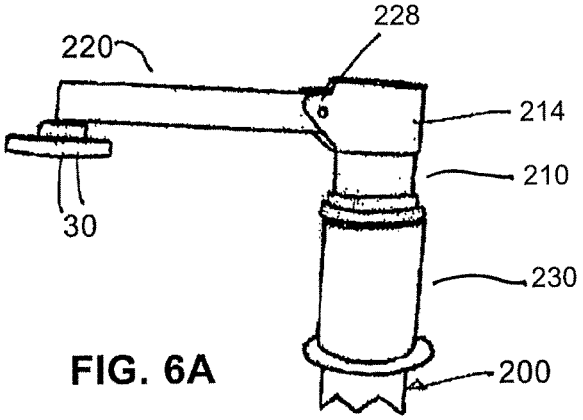
FIG. 6A is a side elevation view of the lever arm 220 pivoted on hinge 228 out of engagement with the slots 226, 227 depicted in FIGS. 4A and 4B and positioned to permit insertion of lower end 320 of upper pole part 300 of the center pole 302 in the lower pole part 200 hollow sleeve 214.
Figure 6B:
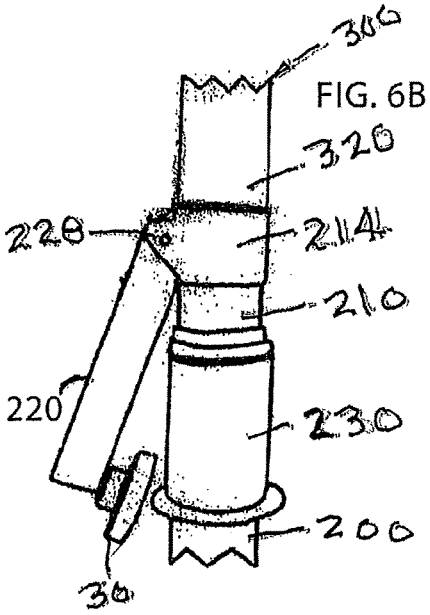
FIG. 6B is a side elevation of the lever arm 220 of FIG. 6A pivoted against the lower pole part 200 of center pole 302 with the lower end 320 of the upper part 300 of the pole 302 inserted into the sleeve 214.

Next set the lever arm 220 in the open position (FIG. 6A), on the hinge 228. Insert the top part 300 of the umbrella pole 302 in the upper sleeve 214 of the lower part 200 of the pole. Then set the lever arm 220 in the locking position (FIG. 6B). The beach umbrella 100 will be firmly anchored to the ground.

When removing the umbrella 100, the operation will be exactly the same except that the rotation, of course, must be performed in the opposite direction.

When placing the umbrella 100 on different soils the same operation must be performed.

This invention is valuable because the variants of the umbrella 100 are very low cost.

It greatly facilitates placement operations especially for the elderly, ladies and children.

It strongly opposes the action of the wind since the two lateral fins 202 included in the lower end 240 of the pole 200 prevent its pulling out. So the pole 300 will remain firmly anchored to the ground.

Following is a listing of the component parts of the beach umbrella embodiments:

30 knob on lever arm 220
100 beach umbrella
200 lower pole part of center pole 300
201 center hole opening in hollow sleeve 240
202 propeller shaped blades
203 teeth
205 front end part of fin or blade
208 axis of center hole opening 201
210 upper end of lower pole part of center pole
212 lower end of lower pole part 200
214 hollow sleeve with hinge fixed on the upper end of the lower part of center pole
220 lever arm pivotally attached to sleeve 214 by hinge 228
226 slit or slot in sleeve 214
227 slit or slot in sleeve 214
228 hinge on sleeve 214 attached to lever arm 220
230 rotatable sleeve at upper end of lower pole part mounted below fixed hollow sleeve 214
240 hollow tubular sleeve fixed to lower end of lower pole part 200
300 upper pole part of center pole
302 center pole
320 lower end of upper pole part of center pole
360 canopy

The invention claimed is:

1. A beach umbrella comprising in combination: a center pole including a lower pole part with a lower end having a first diameter, and an upper end and said center pole further including a separate upper pole part with a lower end and an upper end, said upper pole part lower end attachable to the upper end of the lower pole part and a canopy supported on the upper end of the upper pole part;

said lower pole part further including a hollow, tube shaped sleeve affixed to the lower end of the lower pole part and extending axially therefrom, said hollow tubular shaped sleeve including a central hole in a lower end opening with a diameter about equal to the lower end first diameter of the lower pole part lower end to allow sand to flow without friction into the sleeve and penetrate the sand with reduced friction;

said hollow sleeve lower end further including at least two propeller shaped blades projecting outwardly, laterally from an external part of the sleeve lower end above the opening and further including one or more teeth projecting from the sleeve lower end generally away from the lower pole part lower end to facilitate penetration of the soil or sand;

said upper pole part and lower pole part being connectable by a coupling member comprising a sleeve mounted on the upper end of the lower pole part to receive the lower end of the upper pole part; and a hinge mounted on the coupling member on the upper end of the lower pole part and a lever arm pivotally mounted on the hinge for movement between a first position to substantially horizontally engage the coupling member of the lower pole part to rotate the lower pole part and penetrate the blades and lower pole part into sand or soil; and a second position of disengagement of the lever arm from the first position to substantially vertically against the lower pole part for locking the upper pole part to the lower pole part.

2. The umbrella of claim 1 including a rotatable sleeve on the lower pole part located adjacent the upper end thereof and configured for manual gripping.

3. The umbrella of claim 1 comprising two blades and wherein the blades extend laterally in opposite directions.

4. The umbrella of claim 3 including a rotatable sleeve on the lower pole part located adjacent the upper end thereof and configured for manual gripping.

5. The umbrella of claim 1 including at least two teeth between two blades, said teeth extending axially from the sleeve lower end at the lower end opening.

6. The umbrella of claim 5 including a rotatable sleeve on the lower pole part located adjacent the upper end thereof and configured for manual gripping.

7. The umbrella of claim 1 including one or more pairs of the blades and one or more pairs of the teeth, said teeth and blades positioned alternately around the opening.

8. The umbrella of claim 7 comprising two blades and wherein the blades extend laterally in opposite directions.

* * * * *